United States Patent [19]

Lutzenberger

[11] 3,947,391

[45] Mar. 30, 1976

[54] ELECTRICAL SLIDE SWITCH

[75] Inventor: Kurt Lutzenberger, Arlington Heights, Ill.

[73] Assignee: Switchcraft, Inc., Chicago, Ill.

[22] Filed: Sept. 20, 1974

[21] Appl. No.: 507,721

[52] U.S. Cl. ..... 200/16 D; 200/291

[51] Int. Cl.[2] ..... H01H 15/06; H01H 1/50

[58] Field of Search ..... 200/11 EA, 16 C, 16 D, 200/76–78, 291, 284, 11 D

[56] References Cited

UNITED STATES PATENTS

| | | | |
|---|---|---|---|
| 2,828,393 | 3/1958 | Wingard | 200/284 X |
| 3,219,785 | 11/1965 | Allison | 200/284 X |
| 3,255,319 | 6/1966 | Paine | 200/11 EA |
| 3,501,599 | 3/1970 | Horecky | 200/16 D |
| 3,502,825 | 3/1970 | Bailey et al. | 200/16 D |
| 3,525,827 | 8/1970 | Allison | 200/11 D |
| 3,560,672 | 2/1971 | Ludlum et al. | 200/11 D |
| 3,596,013 | 7/1971 | Pihl | 200/11 EA |
| 3,629,526 | 12/1971 | Lewis | 200/16 C |
| 3,843,852 | 10/1974 | Lockard | 200/16 D |

*Primary Examiner*—James R. Scott

*Attorney, Agent, or Firm*—Johnston, Keil, Thompson & Shurtleff

[57] ABSTRACT

An improved electrical slide switch is provided having electrically conducting terminals embedded in a molded supporting structure thereby eliminating the conventional terminal board in which the terminals have to be mounted in openings provided for that purpose, and further characterized by slidable contacting elements which reduce to a minimum frictional contact during position changes thereby reducing wear and increasing the durability.

8 Claims, 11 Drawing Figures

ELECTRICAL SLIDE SWITCH

BACKGROUND

Electrical slide switches are well known in the art as disclosed for example in U.S. Pat. Nos. 3,485,966 and 3,502,825. In these switches the slider or sliders, which are connected to an actuator, establish electrical contact with terminals that are individually mounted in a terminal board.

In switches of this type, the terminals have to be inserted through openings in the terminal board and thereafter secured in place by spreading portions of the terminals above the terminal board. These portions of the terminals which extend above the terminal board are contacted by the slider or sliders mounted in the actuator and therefore have to be perfectly aligned. The mounting of these terminals in the terminal board is a rather tedious operation requiring careful control.

In addition to the labor problems involved in making slider switches of the type described, these switches also suffer from a disadvantage that is common to slider switches in general, namely that the movement of the slider elements from one position to another abrades and erodes the contact terminals and tends to reduce the life of the switch.

OBJECTS

One of the objects of the present invention is to provide a new and improved type of electrical slide switch in which the electrically conducting terminals are embedded in a molded supporting structure thereby eliminating the conventional terminal board in which the terminals have to be mounted in openings provided for that purpose.

Another object of the invention is to provide a new and improved electrical slide switch in which the movement of the slidable contacting elements is controlled so as to reduce to a minimum the frictional contact which occurs between the slider element and the terminals during position changes thereby reducing wear and increasing durability.

Other objects and advantages of the invention will be apparent from the following description in conjunction with the accompanying drawings.

THE DRAWINGS

Figure 1:
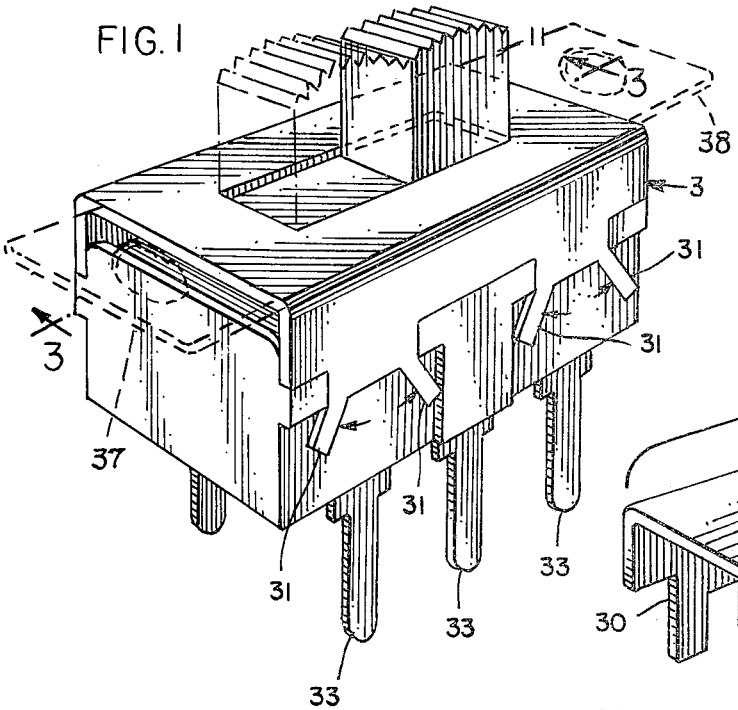
FIG. 1 represents a perspective view of a slide switch embodying the invention.
Figure 10:
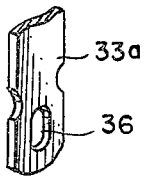
Figure 2:
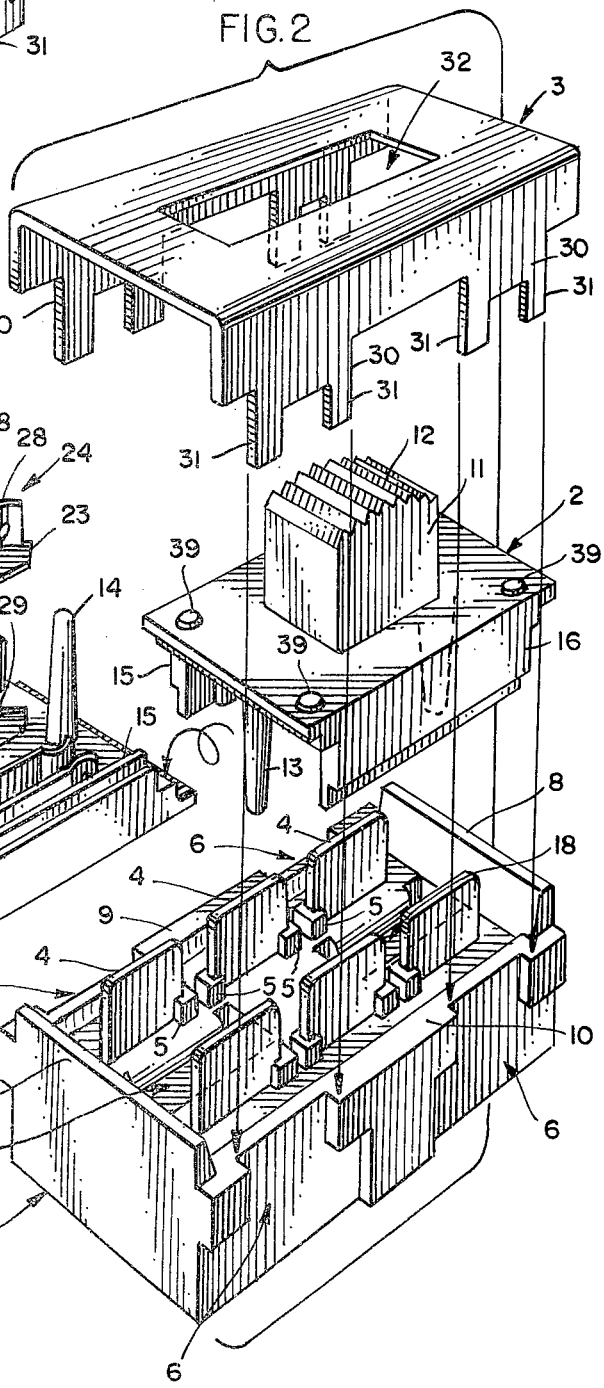
FIG. 2 is an exploded view in perspective of the components of the slide switch shown in FIG. 1.
Figure 2A:
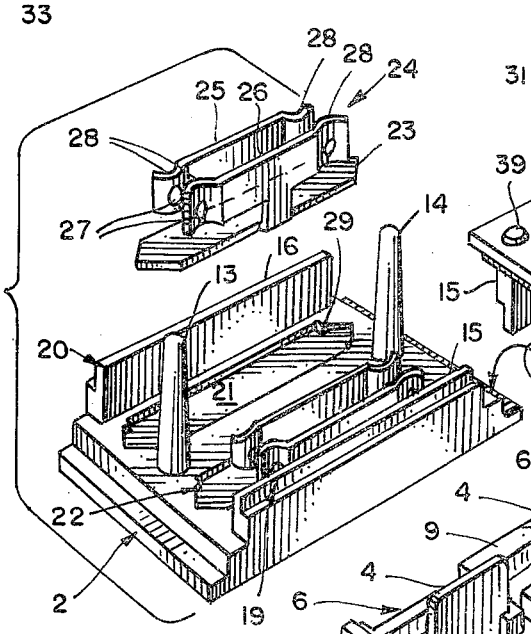
Figure 3:
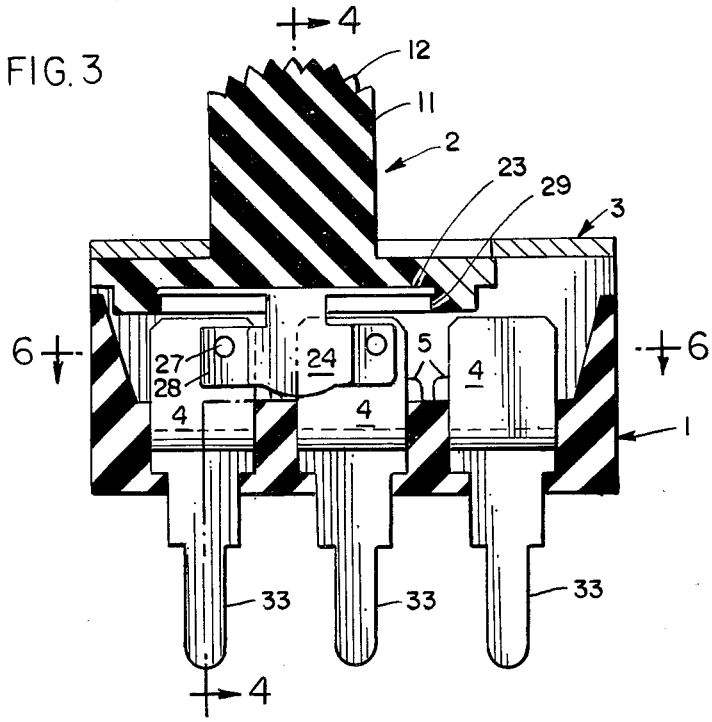
Figure 4:
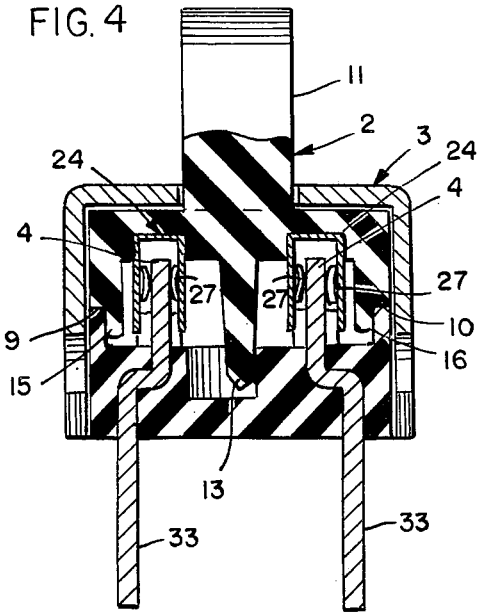
Figure 5:
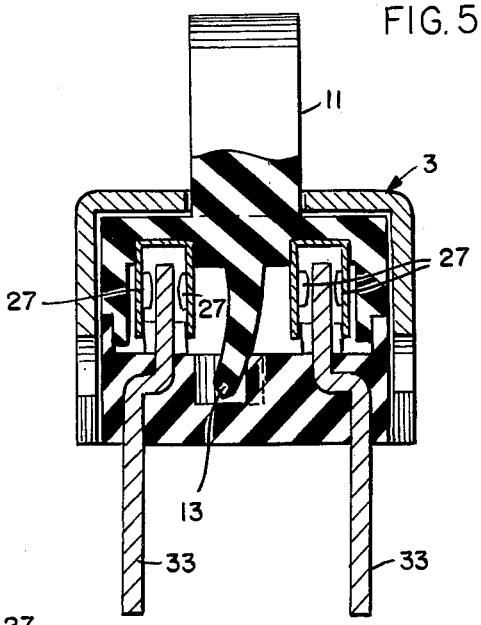
Figure 6:
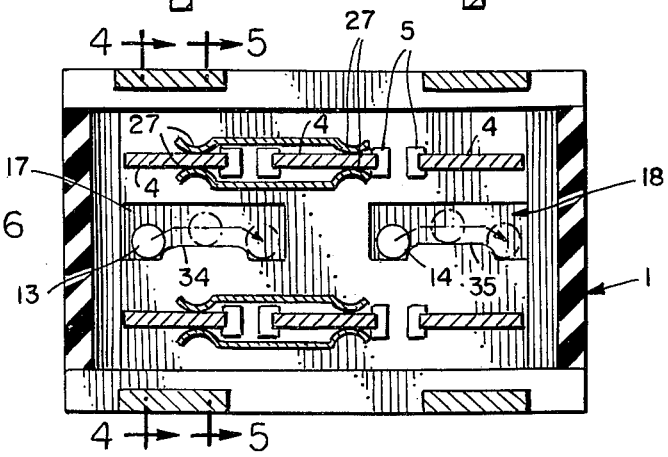
Figure 8:
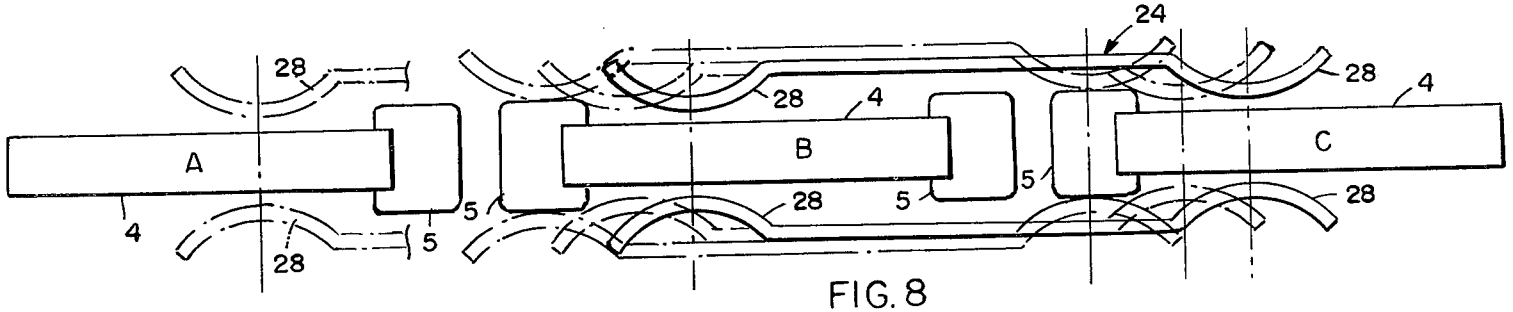
Figure 9:
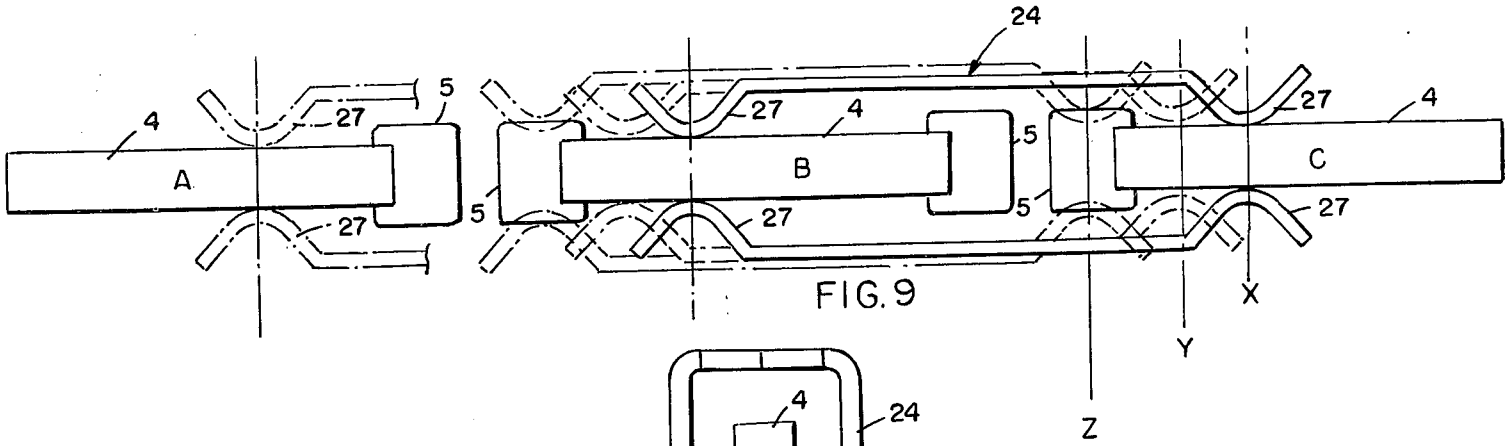
Figure 7:
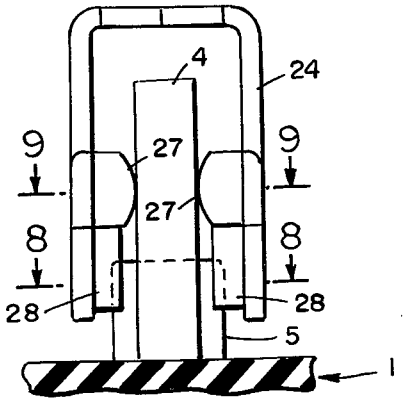

FIG. 2*a* is an exploded view in perspective of certain components of the slide switch of FIG. 2 which are not visible in FIG. 2 and are shown in an inverted position in FIG. 2*a*;

FIG. 3 is a sectional view taken along the line 3—3 of FIG. 1;

FIG. 4 is a sectional view taken along the line 4—4 of FIG. 3;

FIG. 5 is a sectional view similar to FIG. 4 but with the switch of FIG. 4 in the position shown by the line 5—5 in FIG. 6;

FIG. 6 is a sectional view taken along the line 6—6 of FIG. 3;

FIG. 7 is an enlarged end view showing the slider element in contact with one of the fixed electrically conducting elements;

FIG. 8 is a diagrammatic view illustrating the relationship between the slider element and the fixed terminals whereby the slider element is always kept out of contact with the fixed terminals;

FIG. 9 is a diagrammatic view illustrating the positions of the electrical contacts on the slider element and the lifting of said contacts with respect to the fixed terminals as the slider element is moved from one position to another; and FIG. 10 is a perspective view with parts broken away of a solder type terminal which can be used instead of the printed circuit board type terminal shown in FIGS. 1 and 3.

BRIEF SUMMARY OF THE INVENTION

In accordance with the invention, an electrical slide switch is provided comprising a housing, a slidable electrical conductor, an actuator for said conductor mounted in said housing and a base having a plurality of fixed electrically conducting terminals mounted therein in spaced relationship electrically insulated from one another and adapted to receive and establish contact with said slidable conductor as it is moved from one position to another so as to electrically connect a plurality of said terminals, lifting means operative to lift away the portion of said slidable conductor which normally contacts a terminal and to retain said portion in lifted position as said slidable conductor is moved from one terminal and approaches a second terminal until said slidable conductor reaches a predetermined rest position with respect to said second terminal.

DETAILED DESCRIPTION OF THE INVENTION

Referring to the drawings, the embodiment of the invention illustrated therein comprises a molded base 1, an actuator 2 and a housing 3 as shown by the exploded view in FIG. 2.

The molded base 1 is made from a plastic or other suitable electrically insulating material and the terminals or leads 4 are molded therein at the time the base is formed. A series of lifting posts 5 is also molded into the base at the time it is formed.

The sides of base 1 are formed with channels 6. The ends 7 and 8 of base 1 extend upwardly above the top edges 9 and 10 on either side.

Actuator 2 is also molded from an electrically insulating plastic or other suitable material, preferably one which is capable of being mechanically worked for the reasons hereinafter explained. A knob 11 having a striated upper portion 12 capable of being grasped by the fingers is integrally molded with actuator 2. Posts 13 and 14 are also integrally molded with actuator 2 and extend downwardly below the bottoms of sides 15 and 16 so as to engage recesses 17 and 18 in base 1 when the switch is assembled. Actuator 2 has an offset portion 19 in side 15 and an offset portion 20 in side 16, each of said offset portions forming a recess or channel adapted to be received by the upper edges 9 and 10 of molded base 1. Thus, the upper edges 9 and 10 form a trackway for moving the actuator 2 back and forth. Actuator 2 also contains recesses 21 and 22 which are adapted to receive the base 23 of slider element 24.

Slider element 24 is made from an electrically conducting metal and is preferably stamped so that it has two opposing allochiral elongated blades 25 and 26, each having adjacent the ends thereof a first projecting portion 27 which is preferably in the form of an embossment and projects inwardly so as to contact the terminals 4 when the slider element 24 is in a predetermined rest position. The slider element 24 also has adjacent the ends thereof projecting portions 28 which project inwardly and do not contact the terminals 4.

The slider element 24 is mounted in actuator 2 by inserting the base 23 in recess 21 and upsetting the ends 29 of the sides of recess 21 at the four corners thereof. As will be seen from FIG. 2a, in the embodiment shown, the actuator element 2 contains two slider elements 24. After the slider elements 24, 24 have been inserted in the recesses 21 and 22 and secured therein, the actuator 2 is positioned on molded base 1 with the posts 13 and 14 in recesses 17 and 18 and with the sides 15 and 16 mounted on edges 9 and 10. The housing 3, which is preferably formed of metal or other suitable material capable of being bent, is then placed over the assembly of the actuator 2 and the base 1 with the depending sides 30 inserted in recesses 6 until the projections 31 extend beyond the ends of said recesses, whereupon the projections 31 are spread outwardly as shown in FIG. 1 so as to lock the housing 3 in place. The assembly of the switch is now complete with the knob 11 projecting through openng 32 in the housing and the outer ends 33 projecting outwardly so that they can be fastened to wires or other suitable conductors.

In the operation of the switch, as illustrated by FIGS. 3—9, the actuator moves from one rest position connecting two terminals to another rest position connecting one of said terminals and a third terminal. As previously indicated, the slider elements have adjacent the ends thereof contact projections usually in the form of dimples or embossments 27, 27 which contact opposite sides of the terminals 4 when the slider element 24 is in rest position with the circuit established between two consecutive elements 4. The projections 28, 28 on the slider elements 25, 26 do not contact terminals 4 because they do not project inwardly as far as the contact dimples 27, 27. When slider 24 is moved from one rest position to another, the projections 28 contact lifting or spreading elements 5, causing the contact projections or dimples 27 to be spread or lifted away from terminal 4 and to continue to be spread or lifted away from terminal 4 until the slider 24 reaches the next rest position, whereupon the projecting portions 28, 28 are no longer held away by posts 5 and contact projections 27, 27 again make electrical contact with terminals 4. Inasmuch as the electrical contact projections 27, 27 do not make contact with the terminals 4 during the movement of the slider from one position to another, and inasmuch as the spreading or lifting projections 28, 28 never make contact with the terminals 4 but only with the spreading or lifting posts 5, there is no possibility for either the terminals 4 or the contacting projections 27 to be worn away or eroded by friction during the movement of the actuator 2.

The operation of the various components during the movement of the slider element from one position to another is illustrated particularly in FIGS. 7 to 9. FIG. 7 is an end view showing the contacting projections 27, 27 of slider 24 in a rest position with the projecting portions 28, 28 in normal position out of contact with the terminal 4 and out of contact with spreading or lifting posts 5. It will be seen that the heights of lifting posts 5 are such that their tops are always below electrical contact projections 27, 27.

For the purpose of illustrating the operation of the slider switch, FIG. 7 may be regarded as an end view of FIGS. 8 and 9 looking from right to left. FIG. 8 may be regarded as a plan view taken along the line 8—8 of FIG. 7 and FIG. 9 may be regarded as a plan view taken along the line 9—9 of FIG. 7. In position X as shown in FIGS. 8 and 9, the contact dimples 27, 27 are in electrical contact with terminal C at one end of slider 24 and with terminal B at the other end of slider 24. The projecting portions 28 are out of contact with both terminals C and B. When the slider element 24 is moved from position X to position Y, the projections 28, 28 begin to contact post 5. This causes contact projections 27, 27 to move away from terminal C and as the movement of slider element 24 continues from position Y to position Z, the projecting elements 28, 28 ride over post 5 causing electrical contact projections 27, 27 to move outwardly and to be held outwardly away from terminals B and C. This action continues until projecting portions 28, 28 pass beyond the posts 5, whereupon the electrical contact projections 27, 27 are permitted to again establish electrical contact with the fixed terminal A as shown in dotted lines in the left-hand position in FIGS. 8 and 9. In this position, as in the original position, the projection portions 28, 28 will remain out of contact with the terminal.

Referring to FIG. 6, it will be noted that the posts 13 and 14, which serve to limit the movement of actuator 2, move in recesses 17 and 18 which have inwardly projecting sides 34 and 35 that cause the posts 13 and 14 to move in a curved or arcuate path from one position to another. At the ends of this path adjacent the ends of recesses 17 and 18, a pocket or recess is formed so that the posts 13 and 14 retain the actuator 2 in a rest position from which it cannot be dislodged without exerting some pressure on the knob 11. When pressure is exerted on the knob 11 so as to move actuator 2, the posts 13 and 14 ride around the inwardly projecting walls 34 and 35 of recesses 17 and 18. The posts 13 and 14 are sufficiently resilient so that they will bend slightly as shown in FIG. 5 when they reach the middle position shown in dotted lines in FIG. 7 between the two rest positions of the actuator. Due to the resilience of the posts 13 and 14 and the fact that they are constantly in contact with the sides of recesses 17 and 18, they tend to hold the actuator 2 firmly so that no play occurs in the operation of the switch.

One of the optional embodiments of the invention is the addition of mounting tabs 37 and 38 to the housing 3, as shown in dotted lines in FIG. 1. Another optional embodiment is the provision of embossments or dimples 39 (see FIG. 2) at the four corners of the upper surface of actuator 2 which serve as contact points with the inner surface of housing 3 so as to reduce friction and facilitate the sliding action of actuator 2. Another optional embodiment is the substitution of solder terminals 33a, as shown in FIG. 10, having an opening 36 to receive soldered wires for the solid terminals 33, as shown in FIGS. 1 and 3 which are normally used with printed circuit boards.

In addition to the other features of the invention, it should be noted that the offset portions 19 and 20 of the actuator 2, which act as flanges to hold actuator 2 on the upper edges 9 and 10 of molded base 1, also enhance the electrical insulating effect between housing 3 and slider element 24 by providing a circuitous rather than a linear path at the juncture of offset portions 19 and 20 with edges 9 and 10.

The invention provides a very compact electrical slide switch which is especially adapted for small or miniature switches and at the same time has many advantages in the manufacture of all sizes of electrical slide switches. Among these advantages are (1) simplification of manufacture resulting from molding the terminals into the base during the formation of the base, thereby eliminating the insertion of terminals through holes in a terminal board and also eliminating contamination through such holes, (2) providing a slide switch in which looseness or play of the moving parts is reduced to a minimium, and (3) providing a slide switch in which abrasion and erosion of electrical contacts is reduced to minimum.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the form herein disclosed being a preferred embodiment for the purpose of illustrating the invention.

The invention is hereby claimed as follows:

1. An electrical slide switch comprising a housing, a slidable electrical conductor blade, an actuator for said conductor blade mounted in said housing and a base having a plurality of fixed electrically conducting terminals mounted therein in spaced relationship electrically insulated from one another to receive and establish contact with said slidable conductor blade as it is moved from one position to another so as to electrically connect a plurality of said terminals, lifting means operative to lift away the portion of said slidable conductor blade which normally contacts a terminal and to retain said portion in lifted position as said slidable conductor blade is moved from one terminal and approaches a second terminal until said slidable conductor blade reaches a predetermined contacting position with respect to said second terminal, said slidable conductor blade comprising first projecting contacting portions which establish electrical contact between said blade and said terminals and second projecting portions which project toward said terminals but do not contact them and said lifting means comprising projections from said base which engage said second projecting portions and spread them so that said contacting portions are held away from said terminals as the slidable conductor blade is moved between terminals.

2. A slide switch as claimed in claim 1 in which said slidable conductor comprises an electrically conducting slider element to establish electrical contact with said terminals, said slider element having two opposing allochiral elongated blades, each having adjacent the ends thereof a first projecting portion which projects inwardly and contacts opposite sides of said terminals when said slidable conductor is in said predetermined contacting position and a second projecting portion which projects inwardly and does not contact said terminals.

3. A slide switch as claimed in claim 1 in which said slidable conductor comprises a one-piece slider element formed from a sheet of electrically conducting material having the general cross-section of an inverted U with the opposite sides of the U elongated to form blades, and the central portion of the U elongated and flat to form a generally rectangular flat base member which is longer than said blades, said actuator being formed from a molded electrically non-conducting material with a recess therein adapted to receive said flat base member, the sides of said recess being upset to hold said slider element in fixed relationship to said actuator.

4. A slide switch as claimed in claim 2 in which said blades of said slider element each contains adjacent its ends an embossment projecting inwardly to form a contactor for said terminals and an arcuate area projecting inwardly a distance less than said embossment.

5. A slide switch as claimed in claim 1 in which said lifting means comprises posts on said base adjacent said terminals and projecting means on said slidable conductor adapted to contact said posts when said slider is moved from one position to another and to spread said slidable conductor so that it no longer contacts said terminals during such movement.

6. An electrical slide switch having a housing, a slidable electrical conductor, an actuator for said slidable conductor mounted in said housing and a base having a plurality of fixed electrically conducting terminals mounted therein in spaced relationship electrically insulated from one another to receive said slidable conductor as it is moved from one position to another so as to electrically connect a plurality of said terminals, said actuator and said base having an interfitting post and recess to limit the movement of said slidable conductor, said recess being elongated and arcuate and said post bearing against an arcuate side of said recess during movement of said post between the ends of said recess, said post being sufficiently rigid to retain an upright position when resting at the ends of said recess and being sufficiently resilient to bend slightly during linear movement of said actuator while contacting the arcuate side of said recess so as to hold the actuator firmly.

7. An electrical slide switch having a housing, a slidable electrical conductor, an actuator for said slidable conductor mounted in said housing and a base having a plurality of fixed electrically conducting terminals mounted therein in spaced relationship electrically insulated from one another to receive said slidable conductor as it is moved from one position to another so as to electrically connect a plurality of said terminals, said base being formed from a molded insulating material and having channels molded in the sides thereof and said housing being formed of a sheet material having an inverted U shaped cross-section with an opening in the top thereof to receive said actuator and depending side portions engaging said channels in the sides of said molded base and locked to said sides by engagement with the ends of said channels.

8. An electrical slide switch having a housing, a slidable electrical conductor, an actuator for said slidable conductor mounted in said housing and a base having a plurality of fixed electrically conducting terminals mounted therein in spaced relationship electrically insulated from one another to receive said slidable conductor as it is moved from one position to another so as to electrically connect a plurality of said terminals, said base being formed from a molded insulating material, and having upper edges to receive said actuator, said actuator being formed from a molded insulating material and having downwardly depending sides the lower ends of which are offset laterally inwardly to provide recesses the sides of which engage upper edges of said molded base which act as a trackway between said slidable conductor and said housing, the juncture between said actuator and said base also providing a circuitous rather than a linear path between said housing and said slidable conductor, thereby enhancing the electrical insulating effect between said slidable conductor and said housing.

* * * * *